US005944031A

United States Patent [19]

Farley et al.

[11] Patent Number: 5,944,031

[45] Date of Patent: Aug. 31, 1999

[54] HAIR STYLE DEVICE

[76] Inventors: Brent L. Farley, 1808 Rambling Ridge La.#301, Baltimore, Md. 21209; Paul R. Hebert, 307 Spring St., Manchester, Conn. 06040

[21] Appl. No.: 08/892,476

[22] Filed: Jul. 14, 1997

[51] Int. Cl.[6] ..... A45D 19/16

[52] U.S. Cl. ..... 132/272; 132/271; 132/120; 132/212; 15/398; 15/227; 34/97; 34/95.2

[58] Field of Search ..... 132/272, 271, 132/227, 228, 120, 212, 207, 112, 114, 116, 117, 119, 119.1; 15/398, 397, 402, 227; 34/97, 95.2; 219/367, 366, 370

[56] References Cited

U.S. PATENT DOCUMENTS

| | | | |
|---|---|---|---|
| 1,083,087 | 12/1913 | Griffiths | 15/402 |
| 3,574,885 | 4/1971 | Jones | 15/227 |
| 3,575,181 | 4/1971 | Rudd | 132/272 |
| 3,949,765 | 4/1976 | Vallis | 132/148 |
| 3,974,840 | 8/1976 | Doyle et al. | 132/272 |
| 4,138,827 | 2/1979 | Baugh et al. | 34/98 |
| 4,620,374 | 11/1986 | Patterson | 132/212 |
| 5,526,578 | 6/1996 | Iyer | 34/97 |
| 5,613,897 | 3/1997 | Thompson, Jr. | 15/227 |
| 5,718,016 | 2/1998 | Sung | 15/227 |

*Primary Examiner*—John J. Wilson
*Assistant Examiner*—Pedro Philogene
*Attorney, Agent, or Firm*—Richard L. Huff

[57] ABSTRACT

A hair-styling device containing a hand attachmentt and a source for heated air under pressure connected to the hand attachment. The hand attachment is made up of a heat-reflecting member, bands for attaching the hand attachment to a hand, an air chamber, and bristles attached to the air chamber. In one embodiment, the hand attachment is substantially hand shaped and the attachment bands are located on the fingers and wrist so as to allow easy attachment to the hand of the user. In another embodiment, the hand attachment is substantially rectangular in shape and the attachment bands are connected to the sides. Heated air may leave the air chamber through openings in the air chamber between the bristles. Alternatively, air may leave the air chamber through ducts in the bristles. The source of heated air contains a heater and a pump. Preferably, the source is in a base which contains a holder for the hand attachment. The hand attachment is useful in providing a brush for simultaneously drying and styling hair.

16 Claims, 7 Drawing Sheets

HAIR STYLE DEVICE

BACKGROUND OF THE INVENTION

1. Field of the Invention

This invention relates to devices which attach to the hand of a user, which devices simultaneously blow-dry and style hair on mammals.

2. Description of the Related Art

Hand-held devices are known which simultaneously style and dry hair. U.S. Pat. Nos. Des. 251,857 to Harigai, Des. 256,281 to Rosse, Des. 325,794 to Lerner, 3,563,250 to DeFalandre, and 3,696,818 to Weber demonstrate this concept. Each of these patents discloses a device which the user must grasp in order to use. For users suffering from arthritis, the use of such devices can be painful. This problem is intensified by the long time required to dry hair on the user's head. Also, the styling device is rigid, and does not allow for styling in response to the natural hand movement including normal flexing and extension of the hands. Gloves or mittens which contain bristles are also known. Thus, U.S. Pat. No. Des. 268,967 to Sami discloses a mitten containing bristles useful for scrubbing. This device is not intended to be used to style hair. Also, U.S. Pat. No. 277,173 discloses a glove containing bristles which is useful for grooming. This device lacks the advantage of being able to dry the hair. U.S. Pat. No. 4,766,914 to Briggs is the most closely related prior art known to the present inventors. The device shown by this patent is a glove containing comb teeth along the fingers. This device can also be adapted to discharge air to the hair at different locations along the fingers and thumb of the glove. This device has the disadvantage of requiring different sized gloves to be made for different sized hands. Thus, the manufacturer must make a multiplicity of different sized products in order to satisfy the market. The present invention is designed to overcome the disadvantages of the above-discussed products while maintaining their advantages.

SUMMARY OF THE INVENTION

The present invention is directed to a hand attachment which is useful for simultaneously styling and drying hair on mammals. This hand attachment provides a flexible member which has a heat-reflecting distal surface and a proximal surface. Elastic straps are attached to the heat-reflecting member, thus allowing for fast and simple attachment to, and detachment from, the user's hand. An air chamber having front, rear, and side walls and a distal surface is permanently secured to the distal surface of the heat-reflecting member. The distal surface of the air chamber contains a plurality of bristles for styling the hair of a mammal. This surface also contains means for passing air out of the air chamber onto the hair for drying the hair.

The hand attachment is connected to a source of heated air under pressure by way of a flexible duct.

BRIEF DESCRIPTION OF THE DRAWING

Referring to the drawing, wherein like numerals represent like parts throughout the several views.

DESCRIPTION OF THE PREFERRED EMBODIMENTS

Figure 1:
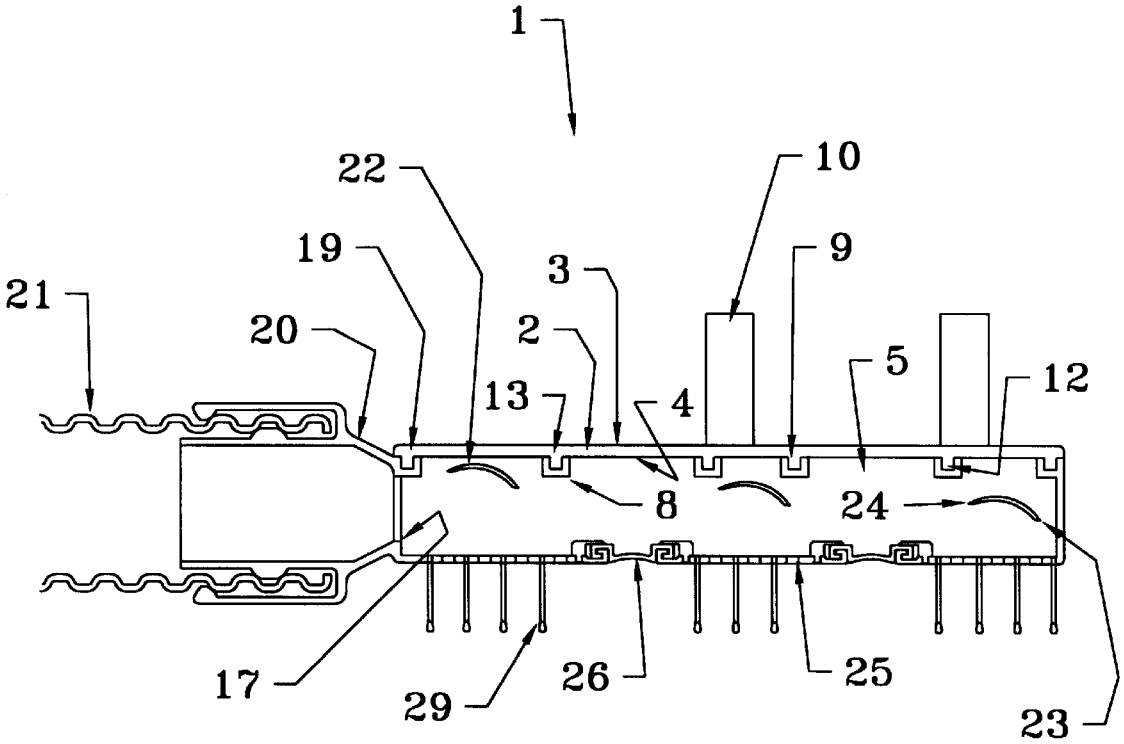
FIG. 1 is a cross-sectional view of a hand attachment according to this invention connected to a flexible duct.
Figure 2:
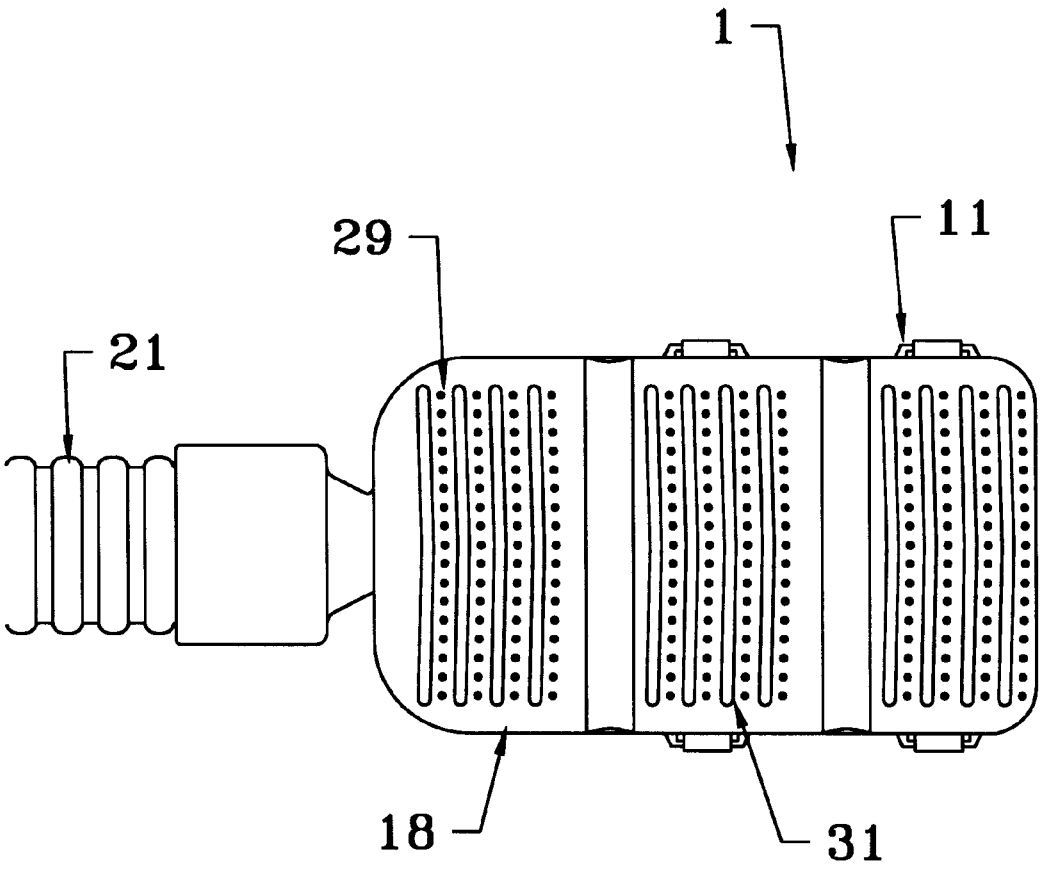
FIG. 2 is a plan view of one embodiment of a hand attachment according to this invention connected to a flexible duct.
Figure 3:
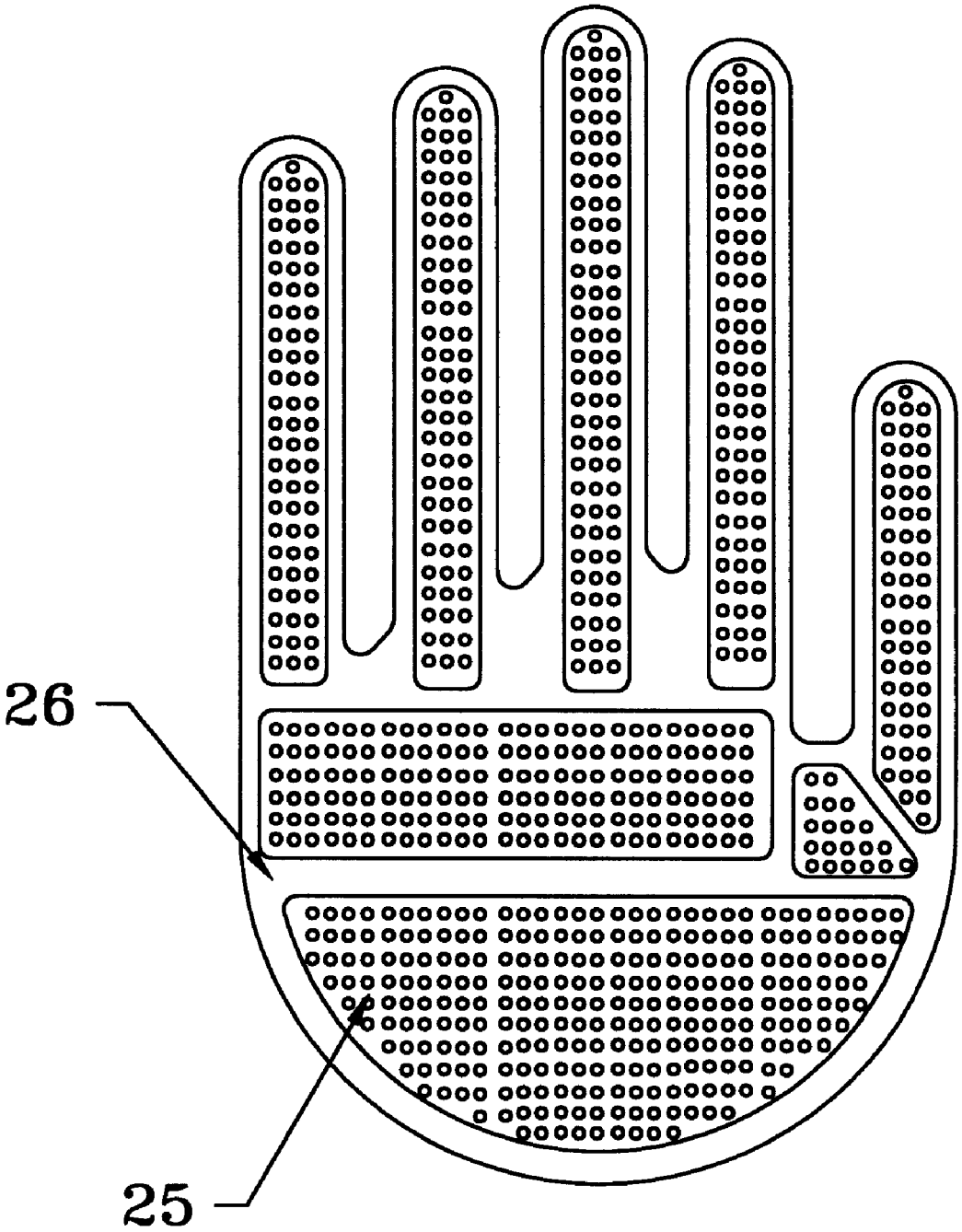
FIG. 3 is a plan view of another embodiment of a hand attachment according to this invention.
Figure 4:
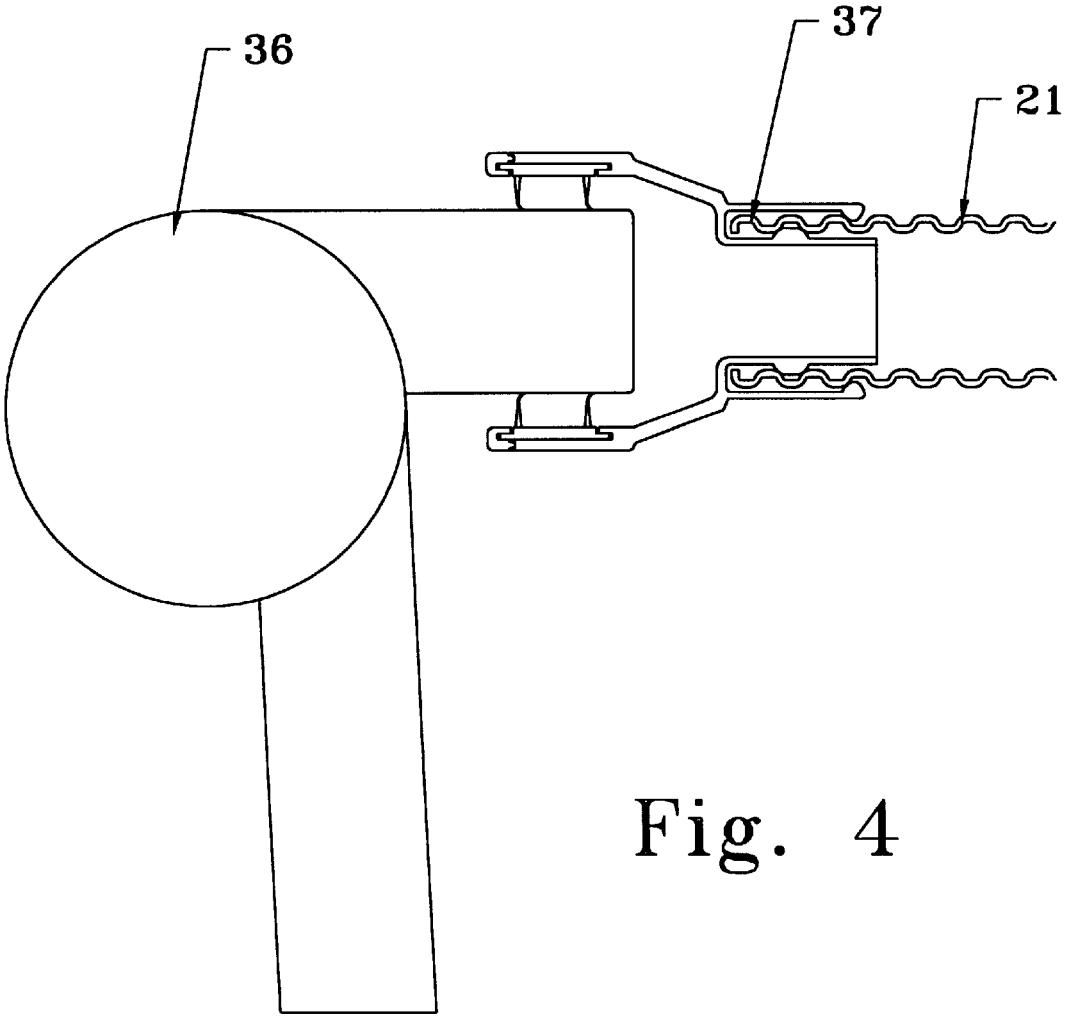
FIG. 4 is a cross-sectional view of a source of heated air under pressure attached to a flexible duct.
Figure 5:
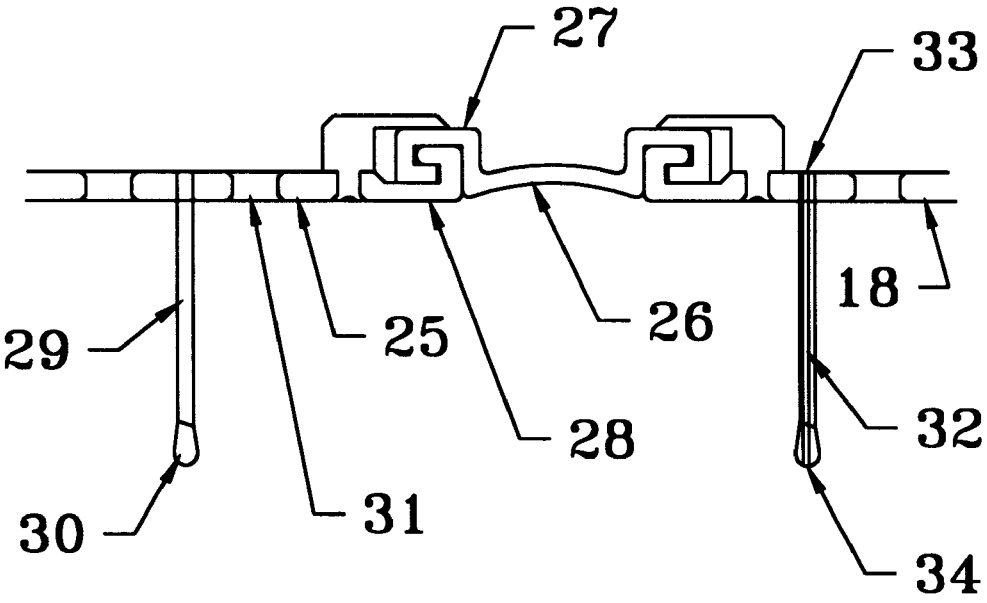
FIG. 5 is a cross-sectional view showing a portion of the distal surface of the air chamber and bristles.
Figure 6:
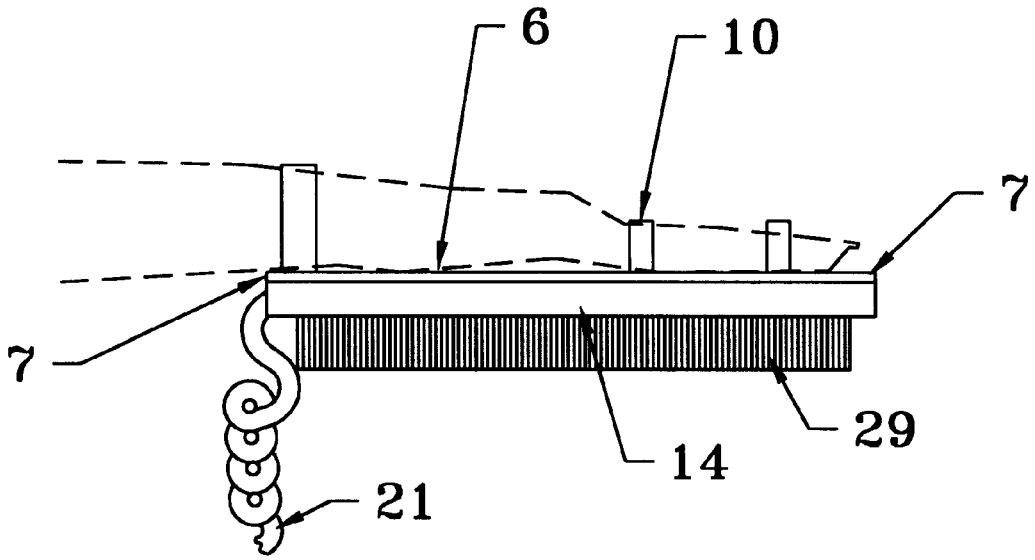
FIG. 6 is a cross-sectional view showing a hand attachment of the present invention attached to an extended hand.
Figure 7:
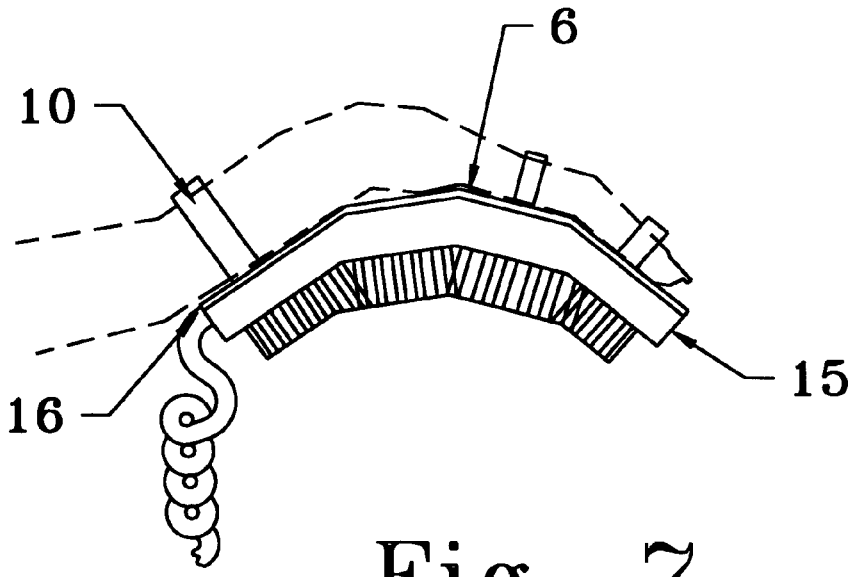
FIG. 7 is a cross-sectional view showing a hand attachment of the present invention attached to a flexed hand.
Figure 8:
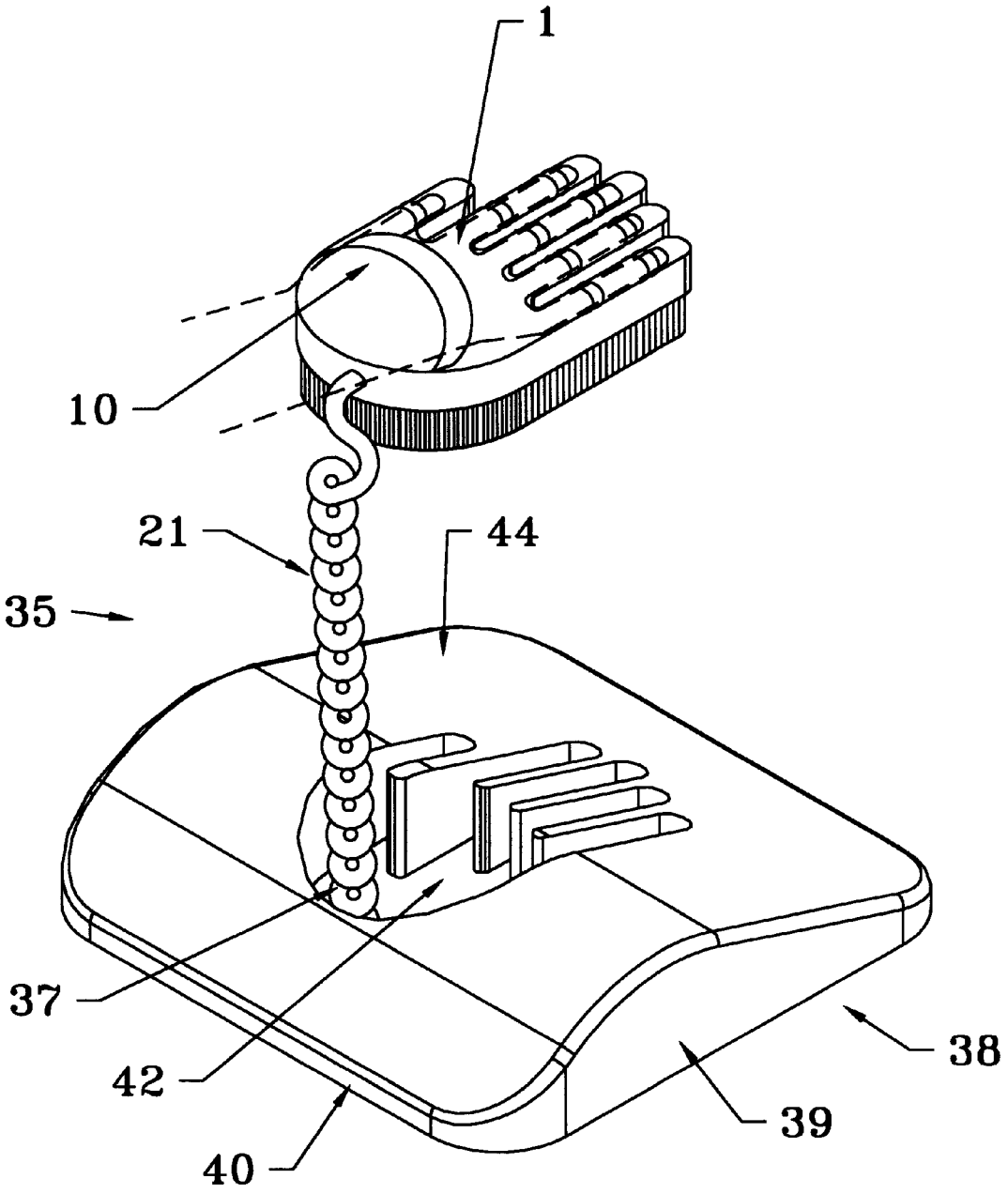
FIG. 8 is an elevational perspective view of one embodiment of the hair styling device of the present invention.

The hand attachment 1 of the present invention is made up of a plurality of parts.

The hand attachment 1 has a flexible heat-reflecting member 2 having a proximal surface 3 and a distal surface 4. The proximal surface 3 is constructed of any known strong, flexible material, but is preferably constructed of molded rubber. The heat reflective distal surface 4 is preferably constructed of Aramid resins, more preferably polybenzimidazole, but any known heat-reflective material may be adhesively attached to the proximal surface 3. The purpose of having a heat reflecting surface is to prevent the hand from becoming uncomfortable as the heated air is flowing through the air chamber 5. The heat reflecting member 2, in addition to the proximal 3 and distal surfaces 4, contains two sides 6 and two ends 7. The heat-reflecting member 2 preferably contains a connecting means 8 for connecting the heat-reflecting member 2 with the air chamber 5. While any convenient means may be used, the preferred means embodies ridges 9 running parallel to the two ends 7, which ridges 9 are useful for the removable or permanent attachment of the air chamber 5.

There is at least one elastic band 10 attached to the heat-reflecting member 2. These bands 10 run parallel to the two ends 7 of this member. The bands 10 may be attached to the sides 6 or the proximal surface 3 of the heat-reflecting member 2 by any known method. These 10 bands are made of elastic material to allow entrance of a hand between the bands 10 and the proximal surface 3 of the heat-reflecting member 2. These bands 10 are also adjustable to allow for use with a multiplicity of hand sizes. This adjustability may be obtained by the employment of hook-and-eye material near the end of each band 10 and the use of loops 11 attached to the sides 6 of the heat-reflecting member 2. It is possible for a single wide band 10 of elastic material to be used, although this is non-preferred as it makes use of unnecessary material and causes folding of the band 10 when there is a change in the flexion or extension of the hand. When the hand attachment 1 is shaped like a hand and has individual surfaces for each digit, it is preferred that each finger have at least one, preferably two, individual bands 10 and that the thumb have a single band 10.

An air chamber 5 has a proximal portion which is removably or permanently attached to the distal surface 4 of the heat-reflecting member 2. Preferably, this attachment is brought about by ridges 9 on the distal surface 4 of the heat-reflecting member 2 and corresponding slots 12 in connecting bars 13 which connect the sides 14 of the air chamber 5 at the top surface of the sides. For permanent connection, an adhesive may be applied between the ridges 9 and the slots 12 during construction. Any other known manner of connecting a top member to an open chamber may be used.

The air chamber 5 has two sides 14, a closed forward end 15, a rearward end 16 which contains an opening 17 for the inflow of warm air, and a distal surface 18. The opening 17 for inflow of warm air contains a means for attachment 19 of a nozzle 20 which is at the forward end of a flexible duct 21 carrying the warm air. Preferably, this is a conventional snap-on fitting.

Preferably, there is at least one baffle 22 in the air chamber 5 for the establishment of the distal flow of warm air. In preferred embodiments, there are three baffles 22 having forward 23 and rearward 24 ends which are arcuate in shape, the forward end 23 being more distal than the rearward end 24. The baffles 22 are fixedly attached to the sides 14 of the air chamber 5.

The distal surface 18 of the air chamber 5 is flexible so as to allow movement corresponding to the flexion and extension of the hand. The flexibility may be accomplished by constructing the distal surface 18 entirely out of flexible material such as plastic or rubber. Alternatively, flexibility may be achieved by constructing strips 25 of the distal surface 18 out of rigid plastic and connecting these strips 25 with flexible joints 26 which are preferably made of flexible plastic or rubber. In this instance, the flexible joints 26 and the rigid strips 25 contain locking clips 27 28 allowing for the permanent movable connection of these strips 25 and joints 26.

The distal surface 18 of the air chamber 5 contains a plurality of bristles 29 for styling the hair. These bristles 29 are permanently mounted in the distal surface 18, preferably by gluing. In the event the distal surface 18 contains rigid strips 25 and flexible joints 26, the bristles 29 are mounted only in the rigid strips 25. Preferably, the bristles 29 contain soft vinyl tips 30 so as to avoid harm to the skin of the mammal.

The distal surface 18 of the air chamber 5 contains means for the distal flow of air. In one embodiment, air flows distally through vents 31 in the distal surface 18. These vents 31 lie between rows of bristles 29. The 31 vents may be in the form of a large number of small openings. Preferably, for ease in manufacturing, a smaller number of slit openings which are perpendicular to the sides 14 are employed for this purpose. In a second embodiment, the bristles 29 are hollow forming longitudinal ducts 32. The ducts 32 at the proximal ends 33 of the bristles 29 open into the air chamber 5 and the ducts 32 at the distal ends 34 of the bristles 29 open into the exterior. The result is that hair may simultaneously be styled by the bristles 29 and dried by the flow of warm air.

Bristles 29 containing ducts 32 may be made by known methods. Extrusion molding of plastic through openings containing central cores is a preferred method.

The hand attachment 1 may be of any convenient shape. It may be rectangular or in the shape of a glove or mitt.

The hair-styling device 35 of the present invention is made up of the just-described hand attachment 1 in combination with a source 36 of heated air under pressure and a flexible duct 21 between this source 36 and the hand attachment 1.

The flexible duct 21 is preferably insulated in order to prevent harm to the user. It may be made of conventional, known materials. Preferably, the duct 21 is prepared in the form of a spiral in order to be compact, yet easily extendible. The nozzle 20 at the forward end of the flexible duct 21 attaches to the rearward surface 16 of the air chamber chamber 5 of the hand attachment 1. The rearward end 37 of the duct 21 attaches to a source 36 of heated air under pressure.

Sources 36 for heated air under pressure are known in the art. Conventional blow-dryers for hair may be used for this purpose. Such source 36 is made up of a conventional air pump or compressor and an air heater. In a preferred embodiment a base 38 serves as a common holder for the source 36 of heated air under pressure and the hand attachment 1. In this embodiment, a base 38 having walls 39, a rearward end 40 and a top surface 41 contains the source 36 for heated air under pressure out of sight within its walls 39. The top surface 41 contains a depression 42 having the general shape of, and being slightly larger than, the hand attachment 1. The flexible duct 21 connects the source 36 for heated air under pressure with the opening 17 in the rearward surface 16 of the air chamber 5 of the hand attachment 1.

The above device 35 allows for the simultaneous drying and styling of hair on a mammal without the possible pain associated with holding a handle for a long period of time and without using a rigid styling device. The light hand attachment 1 of the present invention provides for styling with the natural movement of the users hand.

Changes may be made in the combination and arrangement of parts as set forth in the specification and shown in the drawing. It is understood that any modification in the precise embodiment of the invention may be made within the scope of the following claims without departing from the spirit of the invention.

We claim:

1. A hand attachment comprising:

(a) a flexible heat-reflecting member having a distal heat-reflecting surface and a proximal surface;

(b) at least one elastic band connected to the heat-reflecting member to allow removable attachment of the hand attachment to a hand;

(c) a flexible air chamber having a proximal portion, a distal wall, side walls, a rearward wall, and a forward wall wherein the proximal portion is attached to the distal surface of the heat-reflecting member;

(d) a plurality of flexible bristles permanently attached to the distal wall of the air chamber, the bristles having proximal ends and distal ends, which bristles substantially cover the distal wall of the air chamber, there being a pattern created by the bristles, which pattern contains open areas between the bristles so as to allow curving of the hand attachment; and (e) means for allowing the distal flow of air out of the air chamber.

2. The hand attachment of claim 1, wherein the means for allowing the distal flow of air out of the air chamber comprises a plurality of vents through the distal wall of the air chamber, which openings are located between bristles.

3. The hand attachment of claim 1, wherein the means for allowing the distal flow of air out of the air chamber comprises a plurality of ducts inside bristles going from the proximal end to the distal end of the bristles.

4. The hand attachment of claim 1, wherein the air chamber contains at least one baffle to direct flowing air distally.

5. The hand attachment of claim 1, wherein the hand attachment is substantially rectangular in shape.

6. The hand attachment of claim 1, wherein the hand attachment is substantially hand-shaped.

7. A hair-styling device comprising:

(A) the hand attachment of claim 1;

(B) a source of heated air under pressure comprising an air heater and air pump; and (C) a flexible duct between the source of heated air under pressure and the air chamber of the hand attachment of claim 1.

8. The device of claim 7, wherein the source of heated air under pressure is located in a base, which base contains an opening into which the hand attachment removably fits.

9. A hand attachment comprising:

(a) a flexible heat-reflecting member having a distal heat-reflecting surface and a proximal surface;

(b) at least one elastic band connected to the heat-reflecting member to allow removable attachment of the hand attachment to a hand;

(c) a flexible air chamber having a proximal portion attached to the distal surface of the heat-reflecting member, a distal wall containing a plurality of strips of flexible material interlockingly engaged with a plurality of rigid, bristle-containing strips, side walls, a rearward wall, and a forward wall;

(d) a plurality of flexible bristles permanently attached to the distal wall of the air chamber, the bristles having proximal ends and distal ends, which bristles substantially cover the distal wall of the air chamber, there being a pattern created by the bristles, which pattern contains open areas between the bristles so as to allow curving of the hand attachment; and (e) means for allowing the distal flow of air out of the air chamber.

10. The hand attachment of claim 9, wherein the means for allowing the distal flow of air out of the air chamber comprises a plurality of vents through the distal wall of the air chamber, which vents are located between bristles.

11. The hand attachment of claim 9, wherein the means for allowing the distal flow of air out of the air chamber comprises a plurality of ducts inside bristles going from the proximal end to the distal end of the bristles.

12. The hand attachment of claim 9, wherein the air chamber contains at least one baffle to direct flowing air distally.

13. The hand attachment of claim 9, wherein the hand attachment is substantially rectangular in shape.

14. The hand attachment of claim 9, wherein the hand attachment is substantially hand-shaped.

15. A hair-styling device comprising:

(A) the hand attachment of claim 9;

(B) a source of heated air under pressure comprising an air heater and air pump; and (C) a flexible duct between the source of heated air under pressure and the air chamber of the hand attachment of claim 9.

16. The device of claim 15, wherein the source of heated air under pressure is located in a base, which base contains an opening into which the hand attachment removably fits.

* * * * *